US008096725B2

(12) United States Patent
Bedhome et al.

(10) Patent No.: US 8,096,725 B2
(45) Date of Patent: Jan. 17, 2012

(54) WRITING IMPLEMENT COMPRISING A DEVICE FOR VENTING THE RESERVOIR

(75) Inventors: Vincent Bedhome, Dezvres (FR); Didier Lange, Saint Leonard (FR); Franck Rolion, Asnieres sur Oise (FR)

(73) Assignee: Societe BIC, Clichy Cedex (FR)

( * ) Notice: Subject to any disclaimer, the term of this patent is extended or adjusted under 35 U.S.C. 154(b) by 765 days.

(21) Appl. No.: 12/160,873

(22) PCT Filed: Jan. 12, 2007

(86) PCT No.: PCT/FR2007/000061

§ 371 (c)(1), (2), (4) Date: Jul. 14, 2008

(87) PCT Pub. No.: WO2007/080330

PCT Pub. Date: Jul. 19, 2007

(65) Prior Publication Data

US 2010/0178098 A1 Jul. 15, 2010

(30) Foreign Application Priority Data

Jan. 13, 2006 (FR) ..... 06 00334

(51) Int. Cl.
*B43K 5/00* (2006.01)

(52) U.S. Cl. ..... 401/199; 401/198; 401/223; 401/225; 401/227

(58) Field of Classification Search ..... 401/198, 401/199, 205, 223–225, 227
See application file for complete search history.

(56) References Cited

U.S. PATENT DOCUMENTS

| | | | | |
|---|---|---|---|---|
| 2,462,929 | A | 3/1949 | Zodtner | |
| 2,528,408 | A | 10/1950 | Zodtner | |
| 4,556,336 | A | 12/1985 | Sano et al. | |
| 4,588,319 | A | 5/1986 | Niemeyer | |
| 5,927,885 | A | 7/1999 | Duez et al. | |
| 6,095,707 | A * | 8/2000 | Kaufmann | 401/199 |
| 6,474,894 | B1 | 11/2002 | Baik | |
| 7,101,104 | B2 * | 9/2006 | Witz et al. | 401/198 |
| 2003/0231921 | A1 | 12/2003 | Baik | |

FOREIGN PATENT DOCUMENTS

| | | |
|---|---|---|
| CH | 516 413 | 12/1971 |
| DE | 24 37 503 | 2/1976 |
| FR | 1 026 695 | 4/1953 |
| GB | 503 240 | 4/1939 |
| GB | 688 892 | 3/1953 |

* cited by examiner

*Primary Examiner* — Steven J Ganey
(74) *Attorney, Agent, or Firm* — Jones Day

(57) ABSTRACT

A writing implement that includes an ink reservoir, a writing tip fluidically connected to the reservoir and through which the ink emerges during a use of the implement, and a reservoir-venting device that includes a cavity in communication with the reservoir and with an orifice open to the outside of the implement. The cavity is suitable for absorbing an overflow of ink, characterized in that the cavity is filled with separate grains having angles and sharp edges having dimensions that are significant compared with an apparent dimension d of the grains.

20 Claims, 2 Drawing Sheets

FIG.2.
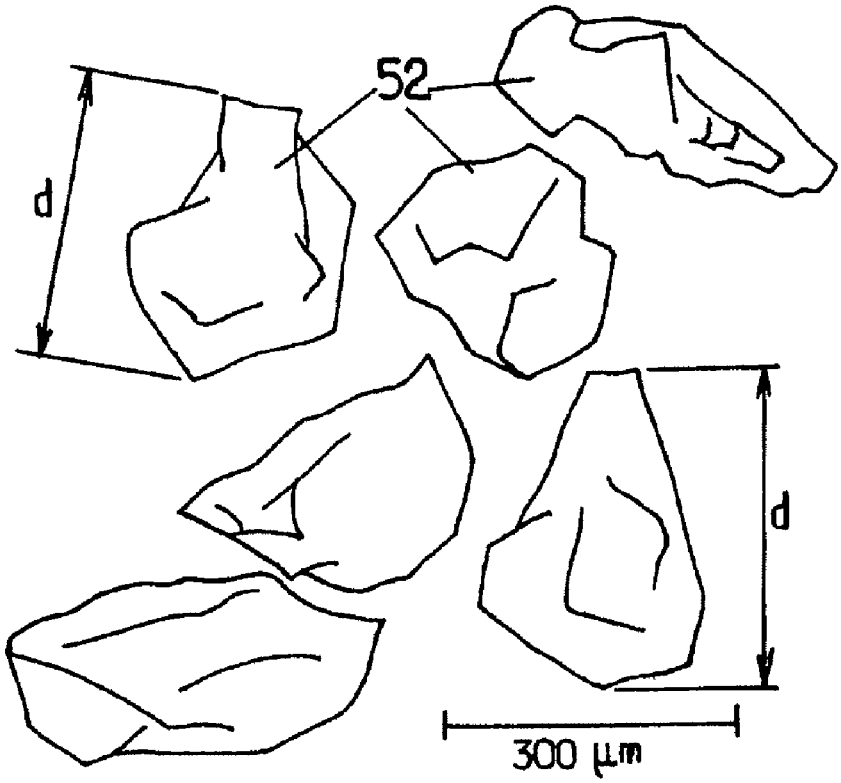
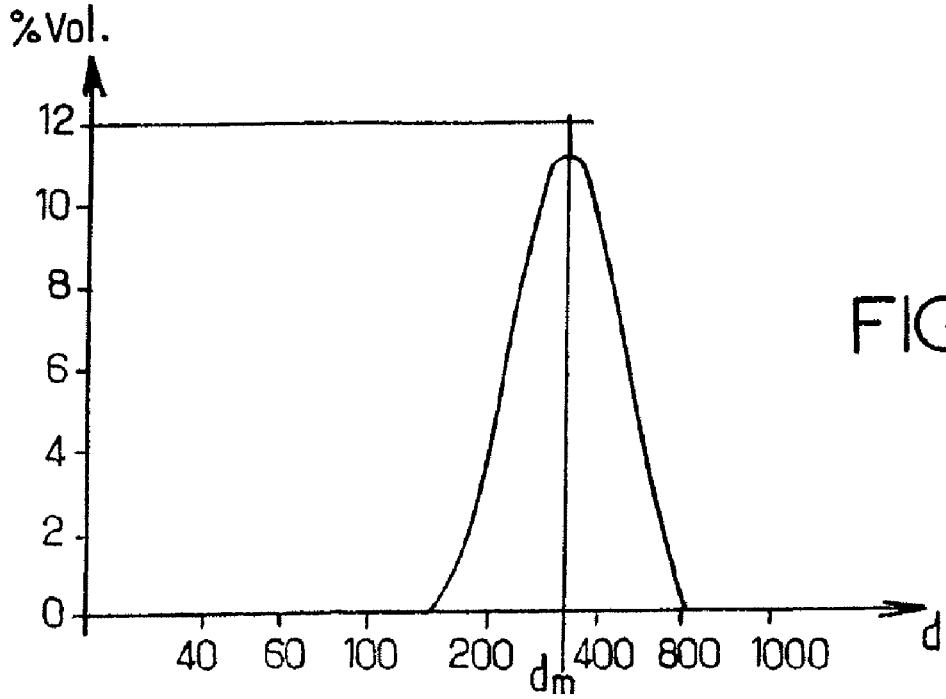
FIG.3.

WRITING IMPLEMENT COMPRISING A DEVICE FOR VENTING THE RESERVOIR

CROSS-REFERENCE TO RELATED APPLICATIONS

This application is a national stage application of International Application No. PCT/FR2007/000061, filed on Jan. 12, 2007, which claims priority to French Patent Application No. 06 00334 filed on Jan. 13, 2006, the entire contents of both applications being incorporated herein by reference.

BACKGROUND OF INVENTION

1. Field of Invention

The embodiments of the present invention relate to a writing implement comprising an ink reservoir, a writing tip and a venting device for the reservoir.

2. Description of the Related Art

The reservoir-venting device acts as an ink buffer. It allows any overflow of some of the ink contained in the reservoir, which would otherwise spread outside the implement through the writing tip, to be absorbed. Such an overflow of ink can be caused, for example, by a temperature variation due to prolonged contact with a user's hand. It can also be caused by excessive pressure in the reservoir, due to the writing implement being struck.

Moreover, when the writing implement is in use, the ink flows from the reservoir to the tip, and emerges from the tip when the latter is moved over a writing medium, such as a sheet of paper. The reservoir is then progressively emptied of the ink, and it is necessary to allow a volume of air equivalent to that of the consumed ink to enter the reservoir in order to prevent the flow of ink from stopping. Another function of the reservoir-venting device is therefore to equalize the pressure in the latter vis-à-vis the air pressure outside the writing implement, such that the ink continues to flow by capillarity from the reservoir to the writing tip.

Several embodiments of a reservoir-venting device are known. Reservoir-venting devices are known, in particular from documents U.S. Pat. No. 4,556,336 and U.S. Pat. No. 6,474,894, which comprise a set of zigzags. The set of zigzags forms a labyrinth which connects the ink reservoir to an orifice open to the outside of the implement. It is formed by a plastic part, which is generally moulded. The absorption of an overflow of ink is achieved by a precise adjustment of the capillarity of the ink in the zigzags. The ink can enter the zigzags, but this entry is limited by capillary forces exerted on the ink by the walls of the zigzags. A drawback of such devices results from the complex shape of the part which defines the zigzags. The moulding of this part is difficult to carry out, and results in a significant additional manufacturing cost for the writing implement.

The document US-A-2003/0231921 discloses another embodiment of a venting device for the ink reservoir. The device comprises a cavity which is filled with a porous element having open porosity. Like the set of zigzags in the previous case, the cavity is in communication, on the one hand with the ink reservoir and on the other hand with an orifice which opens to the outside of the implement. The operation of such a device is based on the capillarity of the ink in the pore volume of the element. However, reproducible large-scale production of a porous element having a specific open porosity is difficult. Its manufacture thus contributes to an increase in the cost price of the writing implement.

SUMMARY OF THE INVENTION

An aim of the embodiments of the present invention is to provide a venting device for the ink reservoir of a writing implement, which can be produced in a simple and economical fashion.

For this, the invention proposes a writing implement comprising an ink reservoir, a writing tip fluidically connected to this reservoir and through which the ink emerges during a use of the implement, as well as a reservoir-venting device. This reservoir-venting device comprises a cavity which is in communication with the reservoir and with an orifice open to the outside of the implement, and which is suitable for absorbing an overflow of ink. According to the embodiments of the invention, the cavity is filled with separate grains which have angles and sharp edges that have dimensions that are significant compared with an apparent dimension d of said grains.

During the absorption of an overflow of ink, some of the ink contained in the reservoir of the writing implement enters the cavity of the reservoir-venting device and disperses between the grains, in interstices formed by adjacent grains.

Given that the grains which are contained in the cavity of the reservoir-venting device are separate grains, they can simply be poured into the cavity. Such a manufacturing step is quick and economical, and helps obtain a writing implement at a low cost.

Moreover, the use of a reservoir-venting device according to the embodiments of the invention allows writing implements with complex or original shapes to be designed and manufactured. In particular, when the reservoir-venting device is situated in a zone where the implement is gripped, this zone can have an ergonomic shape, in order to make the use of the writing implement easier or more pleasant.

These angles and sharp edges of the grains modify the capillary power of the material vis-à-vis the ink in the cavity, such that the ink can enter the cavity between the grains under the action of an excess pressure inside the reservoir, but does not flow freely through the cavity as far as the venting hole. The thus-obtained ink overflow absorption function is particularly effective, and prevents leakages of ink from appearing at the vent orifice or at the writing tip. These angles and sharp edges result from the external shape of the grains. These are therefore raised areas having dimensions of the same order as the apparent dimension d, or the grain size, of a particular grain, i.e. from a few tenths to several hundredths of its apparent dimension d.

In various embodiments of the invention it is also possible, optionally, to make use of one and/or another of the following provisions, which constitute improvements of the invention:

the grains are essentially non-porous;

at least some of the grains can be constituted of a mineral material;

the mineral material of certain grains can comprise sand, calcium carbonate, corundum or crushed glass;

the grains can have an average dimension comprised between 40 μm and 550 μm, this average dimension being determined by laser granulometry over all of the grains contained in the cavity of the reservoir-venting device;

95% of the grains contained in the cavity of the reservoir-venting device can have at least one dimension less than 800 μm;

95% of the grains contained in the cavity can have at least one dimension greater than 0.5 μm;

95% of the grains contained in the cavity can have at least one dimension greater than 150 μm;

the individual dimension of the grains can vary in a ratio of less than 10 for 95% of the grains contained in the cavity;

the grains can have a grain-size distribution according to their individual dimension which has a single maximum; and the ink can be a liquid ink, and preferably an aqueous type of ink;

the grains have not preferably undergone treatment modifying their capillarity vis-à-vis the ink, apart from simple washing operations, and are preferably of natural origin.

In order that the reservoir-venting device can contain an overflow of ink even more effectively, the grains are preferably immobile in the cavity. Thus all the ink is retained between the grains by capillarity, and no relative movement of the grains vis-à-vis the others disturbs this retention.

The cavity of the reservoir-venting device can have a peripheral wall which is at least partly transparent. It is then possible to view an advance of the ink in the cavity, and thus to prevent any leakage of ink through the vent orifice.

Moreover, the cavity of the reservoir-venting device is defined by a chamber that is separate from the reservoir and provided with the orifice, which can be in restricted communication with the ink reservoir in different ways. In particular, it can be directly in communication with the ink reservoir by at least one calibrated hole, or be in communication with the latter via a connector set up to conduct the ink from the reservoir to the writing tip.

The inventors found that a writing implement having a center of gravity situated in the zone for gripping and or/holding the implement in the hand of a user for writing is particularly easy and pleasant to use. In fact, it is then possible to hold and move the implement securely and with good control, so that writing is aided. In particular, the center of gravity of the writing implement can be situated at a distance from the writing tip which is less than half the total length of the implement.

Preferably, the center of gravity of the writing implement is situated at a distance from the writing tip comprised between one sixth and half the length of the writing implement.

When a reservoir-venting device according to embodiments of the invention is situated in the front part of the writing implement, the weight of the grains, in particular when the grains are of a mineral material, helps shift the center of gravity of the implement towards the writing tip.

Finally, the embodiments of the invention can be applied to writing implements of different types. In particular, the writing tip can be a porous capillary tip, for example for a marker or felt-tip pen, a ball point, or an ink rollerball tip.

BRIEF DESCRIPTION OF THE DRAWINGS

Other special features and advantages of the embodiments of the present invention will become apparent in the description below of two non-limitative embodiments, with reference to the attached drawings, in which:

FIG. 2 is a diagrammatic illustration of the sand grains used for the embodiments of the invention; and FIG. 3 is a diagram of the grain-size distribution of the grains contained in the venting device for the ink reservoir of a writing implement according to the embodiments of the invention.

DETAILED DESCRIPTION OF THE INVENTION

Figure 1A:
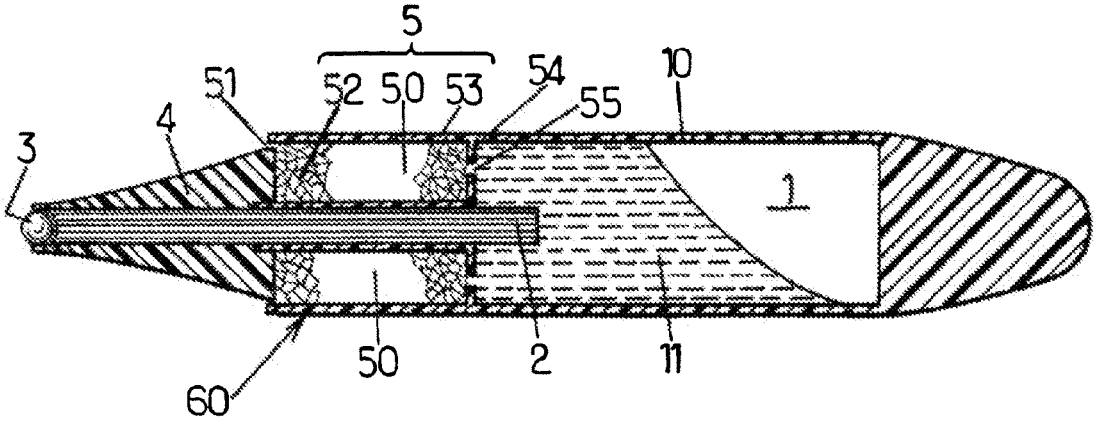
FIGS. 1*a* and 1*b* are respective section views of a writing implement according to two variant embodiments of the invention.
Figure 1B:
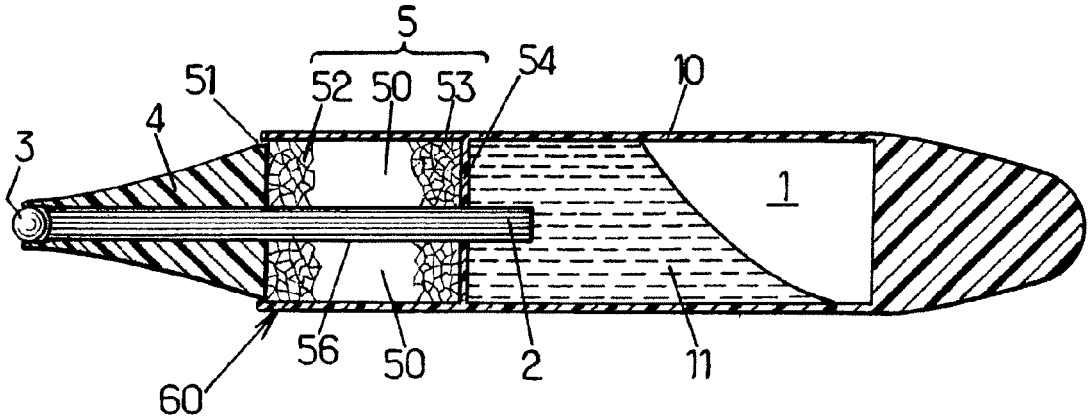

It is understood that the dimensions of the different parts of the writing implements which are shown in FIGS. 1*a* and 1*b* do not correspond to actual dimensions or dimensional ratios. In particular, these dimensions can be adapted in order to obtain a writing implement which can contain a larger amount of ink, or to produce a writing implement which has a pocket format.

By way of example, the writing implement shown in FIG. 1*a* is of "rollerpen" type. It comprises an ink reservoir 1, a connector 2, and an ink roller 3 which constitutes the writing tip. The ink reservoir 1 is limited by an outer peripheral wall 10, which is substantially cylindrical. The reservoir 1 can be of the free ink type, i.e. the ink 11 can move freely in the reservoir. The ink roller 3, while remaining free in rotation, is held in place by a fixture 4 which is fixed on a front end of the reservoir 1. The connector 2 allows a flow of the ink 11 which is contained in the reservoir 1 towards the ink roller 3. It can be constituted by a set of fibers, aligned longitudinally and intended to be impregnated by the ink 11. These fibers are selected according to the capillarity of the ink 11, and are assembled with a controlled density in a substantially cylindrical bundle to form the connector 2. Optionally, one end of the connector 2 can project into the reservoir 1 in order to achieve a good impregnation of the connector 2 over its whole length.

A device 5 for venting the reservoir 1 is inserted between the fixture 4 forming the conical nose of the implement and the reservoir 1. It comprises a cavity 50 which is arranged around the connector 2, and which is limited by an outer peripheral wall 53. The wall 53 of the cavity 50 can be substantially an extension of the wall 10 of the reservoir 1. Moreover, in the longitudinal direction of the writing implement, the cavity 50 is limited by the fixture 4 on the side of the writing tip, and by a separating partition 54 on the side of the reservoir 1. Moreover, the cavity 50 communicates with the open air through an orifice 51, and with the reservoir by one or more holes 55 through the partition 54. Preferably, the orifice 51 is situated on a side of the cavity 50 opposite the hole 55.

The wall 53, the fitting 4 and the partition 54 form a chamber 60, i.e. an essentially closed space with the exception of the orifice 51 and the hole 55, which is separate from the reservoir 1 and delimits the cavity 50 from the venting device. As can be seen in FIG. 1*a*, the holes 55 are calibrated so as to provide a restricted communication between the reservoir 1 and the cavity 50.

The cavity 50 is filled with separate grains 52 of a solid material. Preferably, the grains 52 completely fill the volume of the cavity 50, such that they are immobilized against each other. However, the cavity 50 can be filled leaving a small volume free of grains 52, i.e. not completely filled, while keeping the mobility of the grains restricted enough for the shaking of the implement not to move ink-stained grains close to the orifice 51 communicating with the outside air. It can also be envisaged to reduce the mobility of the grains 52 with an elastically deformable or fibrous element placed in the cavity 50. The separate grains 52 allow quick and easy production of the venting device 5. For this, they are simply poured into the cavity 50, prior to assembly of the fitting 4 onto the front end of the reservoir 1.

An impact applied to the writing implement or an expansion of the air present in the reservoir 1 causes an overflow of the ink 11 contained in the reservoir 1. The quantity of ink corresponding to this overflow passes through the hole 55 and enters the cavity 50. It disperses between the grains 52, in interstices formed by adjacent grains. It is then retained in the cavity 50 under the effect of the capillary power resulting in particular from the shape of the grains 52. The inventors found that angles and sharp edges on the surface of the grains 52 allow a particularly effective overflow absorption capacity to be obtained, such that the ink does not reach the orifice 51. No leakage of ink is then observed, either through the orifice 51 or at the ink roller 3.

Advantageously, the outer wall 53 of the cavity 50 can be transparent, or have a transparent window, for viewing the entry of the ink 11 into the cavity 50. Thus, a leakage of ink through the orifice 51 can be prevented.

Moreover, the orifice 51 makes it possible to compensate a negative pressure in the reservoir 1 which occurs when the ink 11 emerges via the writing tip, during a normal use of the implement for writing.

The ink 11 preferably has a low viscosity. In other words, the ink 11 is liquid, as opposed to greasy inks which have a high viscosity. This can be an aqueous-solvent ink, in particular, but the use of an ink based on an alcoholic or another solvent can certainly be envisaged.

FIG. 1*b* illustrates another possible embodiment of the invention, in which the cavity 50 is in communication with the reservoir 1 via the connector 2. In this other embodiment, the separating partition 54 between the cavity 50 and the reservoir 1 is tight, and the cavity 50 is open to the connector 2, towards the center of the writing implement. This opening can extend over the whole length of the cavity 50, parallel to the longitudinal direction of the writing implement, or over just part of this length. The cavity 50 is thus limited, towards the center of the writing implement, by the lateral surface 56 of the connector 2. This surface 56 is defined by the outside circumference of the bundle of fibers of the connector 2, or by a film which surrounds this bundle. In the latter case, the film is permeable to the ink 11.

Just as in the previous embodiment, the cavity 50 is therefore delimited by a chamber 60 separate from the reservoir 1 and in restricted communication with the latter due to the presence of the connector 2.

When the grains 52 are mineral grains, a capillary behaviour of these grains vis-à-vis the ink 11 is observed in the cavity 50, which is even more favourable for achieving an effective absorption of an overflow of ink. The material of the grains can be of oxide or carbonate type. Alumina, in particular of corundum type, silica, crushed glass, or calcium carbonate are grains materials for which satisfactory operations of the reservoir-venting device were observed. Moreover, these materials are chemically inert vis-à-vis the inks used.

Remarkable ink overflow absorption performance figures were also obtained with sand grains placed in the cavity 50. By "sand" is meant a powder essentially based on silica or calcium carbonate of natural origin. Sands of various origins were tested, corresponding to various quarries. Satisfactory ink absorption performance figures were obtained for a controlled overflow, with natural sands of different origins. However, it appears that, for a given ink, sands from certain origins give better results.

FIG. 2 diagrammatically reproduces a micrograph of such sand grains 52. This micrograph was produced by scanning electron microscopy, with a magnification of ×100. The sharp edges are very visible, as well as the angles between these edges. Thus they are angles and sharp edges having dimensions that are significant compared with the apparent dimension d of the grains. These macroscopic angles and sharp edges are thought to perceptibly and beneficially modify the dynamics of the fluids of the ink between the grains, even the physico-chemical interactions between the ink and the grains.

The interstices between the grains 12 therefore constitute capillary spaces that can vary greatly in volume and shape, due to the irregular shape of each of the grains. It seems that this improves the retention of any overflows of ink that may come from the reservoir 1, the narrow interstices slowing the overflows and the wider interstices acting as a buffer reservoir.

It will be understood that it is the interstices between the grains 52 which constitute the volume of the cavity 50 capable of retaining the ink, given that the sand grains 52 have a virtually zero porosity vis-à-vis the ink. However, the use of grains having a porosity sufficient to contain a not inconsiderable quantity of ink in their pores is not excluded. Nevertheless, the entry of the ink into these pores must be small, due to the restricted dimensions of the latter relative to the interstices. Non-porous grains are therefore preferred.

It will be noted that even in the case of porous grains the latter must have, on the outside, angles and sharp edges of significant dimensions in order that the capillary spaces between the grains fulfil their function, it being understood that the apertures of the pores cannot in themselves constitute such angles and sharp edges. Similarly, microscopic defects or reliefs on the surface of rounded grains or beads would not allow the same capillarity effects of the grains and the interstices vis-à-vis the ink to be achieved. FIG. 3 is a typical distribution diagram of the dimensions of the sand grains. This grain-size analysis was carried out by means of a laser, using a commercially available apparatus. The horizontal axis shows, in microns, the apparent dimension d of each grain, and the vertical axis shows the fraction of the total volume of analyzed sand whose grains have the dimension indicated by the horizontal axis. The area of the surface comprised between the curve and the horizontal axis therefore corresponds to 100%. 95% of the grains of the sand sample corresponding to FIG. 3 have at least one dimension greater than 150 μm. At the same time, 95% of the grains have at least one dimension less than 750 μm. The graph shows a maximum of approximately 320 μm for the grain dimension. This dimension, labelled dm, is also approximately equal to the average dimension of the grains, calculated for the whole of the analyzed sand sample. Such dimensions are adapted so that a large number of grains can be contained simultaneously in the cavity 50, statistically providing a reproducible ink absorption and retention effectiveness of the grains 52. Moreover, these grain dimensions are large enough to prevent some grains 52 from leaving through the orifice 51. Similarly, these dimensions prevent certain grains 52 from passing into the reservoir 1 through the hole 55, or entering the connector 2 through the lateral surface 56 of the latter. Any obstruction of the connector 2 is thus prevented.

Sand grains having different dimensions to those shown in FIG. 3 also gave satisfactory ink overflow absorption characteristics. However, the inventors found that better characteristics are achieved when the average dimension of the grains dm is comprised between 40 μm and 550 μm, and/or when 95% of the grains have a dimension d less than 800 μm, and/or when 95% of the grains have a dimension d greater than 0.5 μm, preferably greater than 150 μm.

Moreover, it is preferable that the grains 52 which are contained in the cavity 50 have limited dimensional variations. In particular, the individual dimension of the grains d varies preferably in a ratio of less than 10, for 95% of the grains. Such a grain-size characteristic makes it possible to prevent a large number of interstices between the largest grains from becoming clogged by smaller grains. The ink capacity of the cavity 50, and therefore the absorption capacity of the reservoir-venting device 5, is then greater. This also makes it possible to prevent a settling or a segregation of the grains 52 according to their dimension, which would take place in the cavity 50 after a long period of immobility of the writing implement. The device 5 then retains a constant effectiveness as an ink buffer in the case of an overflow, even when the use of the writing implement is resumed. Similarly, a grain-size distribution of the grains according to their respective dimensions which has only a single maximum constitutes another criterion for ensuring that the interstices between the grains form a free volume sufficient to receive the ink.

It will be noted that the natural sand constituting the grains 12 can undergo washings, for example to prevent grains of powder or dust on the surface of the grains from changing their capillarity properties. However, treatments that modify the surface of the grains, such as for example chemical etchings or depositions, will be excluded, given the satisfactory results obtained by the shape of the grains and the cost that such treatments could involve.

In the preferred embodiment described above, the reservoir 1 contains exclusively grains of the same type, and preferably of a mineral material. However, it is not excluded that the reservoir can contain a fraction of grains of a different type, for example of polymer or metal material, or also that it can contain a fibrous element, in particular to immobilize the grains.

The filling of the cavity 50 of the venting device 5 with a mineral material such as sand, which has a higher density than plastic materials, can perceptibly increase the weight of the implement. Some users are of the view that, compared with implements comprising a device that vents using a zigzag, this greater weight creates a better sensation when held in the hand. Moreover, the inventors found that with the circular cavity 50 situated between the fitting 4 and the ink reservoir 1, and when this cavity is filled with a heavy material, namely the grains 52, the center of gravity of the writing implement is situated closer to the writing tip 3 than in the case of the comparable earlier writing implements.

Greater comfort when taking in hand and when writing was noted when the position and the volume of the cavity 50, as well as the density of the material filling the latter, are chosen such that the center of gravity is situated in the gripping zone of the writing implement, and more particularly when the center of gravity is situated at a distance from the writing tip comprised between ⅙th and ⅖ths of the total length of the implement in writing configuration, and in particular approximately ⅓ of this length.

It is of course possible to obtain this advantage, which is a separate advantage from the one achieved by the use of grains with sharp edges for the reservoir-venting device, using any type of heavy material, i.e. of which the density is significantly greater than those of the plastic materials widely used to manufacture writing implements. Nevertheless, the use of a granular mineral material not only makes it possible to obtain these two advantages, but also facilitates manufacture due to its fluid character, does not increase the cost excessively and does not pose any particular environmental pollution or recycling problem because of its inert nature. It is therefore more advantageous to obtain this positioning of the center of gravity using a granular mineral material, such as sand, than with solid metal, for example lead.

It is understood that the writing implement described in detail above can be modified, while still preserving at least some of the advantages of the embodiments of the invention. In particular, the invention is not limited to its application to a writing implement of the "rollerpen" type, and can be applied to other types of pens or markers.

The invention claimed is:

1. A writing implement comprising:

an orifice open to the outside of the writing implement, an ink reservoir, a writing tip fluidically connected to the reservoir and through which the ink emerges during a use of the writing implement, and a reservoir-venting device comprising a cavity in communication with the reservoir and in direct communication with the outside through the orifice, the cavity being suitable for absorbing an overflow of ink, wherein the cavity is filled with separate grains having angles and sharp edges having dimensions of the same order as a granulometry dimension of the grains.

2. The writing implement according to claim 1, in which the grains are essentially non-porous.

3. The writing implement according to claim 1, in which at least some of the grains are of a mineral material.

4. The writing implement according to claim 3, in which the mineral material comprises sand, calcium carbonate, corundum or crushed glass.

5. The writing implement according to claim 1, in which the grains have an average granulometry dimension comprised between 40 μm and 550 μm, the average granulometry dimension being determined by laser granulometry over all of the grains contained in the cavity of the reservoir-venting device.

6. The writing implement according to claim 1, in which 95% of the grains contained in the cavity of the reservoir-venting device have at least one granulometry dimension less than 800 μm.

7. The writing implement according to claim 1, in which 95% of the grains contained in the cavity of the reservoir-venting device have at least one granulometry dimension greater than 0.5 μm.

8. The writing implement according to claim 7, in which 95% of the grains contained in the cavity of the reservoir-venting device have at least one granulometry dimension greater than 150 μm.

9. The writing implement according to claim 1, in which the individual granulometry dimension of the grains varies in a ratio less than 10 for 95% of the grains contained in the cavity of the reservoir-venting device.

10. The writing implement according to claim 1, in which the grains have a grain-size distribution according to their individual granulometry dimension which has a single maximum.

11. The writing implement according to claim 1, in which the grains are immobile in the cavity of the reservoir-venting device.

12. The writing implement according to claim 1, in which the cavity of the reservoir-venting device has a peripheral wall which is transparent at least in part.

13. The writing implement according to claim 1, in which the cavity of the reservoir-venting device is delimited by a chamber provided with the orifice and in restricted communication with the reservoir.

14. The writing implement according to claim 13, in which the chamber of the reservoir-venting device is in direct communication with the reservoir via at least one calibrated orifice.

15. The writing implement according to claim 13, in which the cavity of the reservoir-venting device is in communication with the reservoir via a connector set up to conduct the ink from the reservoir to the writing tip.

16. The writing implement according claim 1, in which the writing tip is a porous capillary tip, a ball point or an ink roller tip.

17. The writing implement according to claim 1, in which the ink is liquid and an ink of aqueous type.

18. The writing implement according to claim 1, having a center of gravity situated in a zone where the writing implement is held by a user, during a writing use.

19. The writing implement according to claim 18, having a center of gravity situated at a distance from the writing tip that is less than half the length of the writing implement.

20. The writing implement according to claim 1, in which the grains filling the cavity have not undergone a treatment modifying their capillarity vis-à-vis the ink, apart from simple washing operations, and are of natural origin.

* * * * *